US008678688B2

(12) United States Patent
Shiraishi

(10) Patent No.: US 8,678,688 B2
(45) Date of Patent: Mar. 25, 2014

(54) PRINTING DEVICE AND METHOD

(75) Inventor: Norihisa Shiraishi, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 339 days.

(21) Appl. No.: 12/860,386

(22) Filed: Aug. 20, 2010

(65) Prior Publication Data

US 2011/0058879 A1 Mar. 10, 2011

(30) Foreign Application Priority Data

Sep. 8, 2009 (JP) ..... 2009-207329

(51) Int. Cl.
*B41J 11/00* (2006.01)
*B65H 3/44* (2006.01)

(52) U.S. Cl.
USPC ..... 400/582; 400/583; 400/611; 400/605; 271/9.01; 271/9.1; 271/9.13

(58) Field of Classification Search
USPC ..... 400/582, 188, 583, 611, 624, 608.3, 400/605, 88; 271/9.01, 9.1, 9.12, 9.13, 9.02
See application file for complete search history.

(56) References Cited

U.S. PATENT DOCUMENTS

| | | | | |
|---|---|---|---|---|
| 6,109,805 | A * | 8/2000 | Ono et al. | 400/618 |
| 6,447,182 | B2 * | 9/2002 | Brewington et al. | 400/188 |
| 6,543,946 | B2 * | 4/2003 | Hori et al. | 400/487 |
| 6,786,149 | B1 * | 9/2004 | Lomoine et al. | 101/223 |
| 7,575,233 | B2 * | 8/2009 | Tanaami | 271/273 |
| 2010/0238255 | A1 * | 9/2010 | Inaba | 347/218 |

FOREIGN PATENT DOCUMENTS

| | | |
|---|---|---|
| JP | 2002-073290 | 3/2002 |

* cited by examiner

*Primary Examiner* — Matthew G Marini
(74) *Attorney, Agent, or Firm* — Amin, Turocy & Watson, LLP

(57) ABSTRACT

According to one embodiment, a printing device may include first and second printers respectively having first and second controllers. The first and second printers may be configured to share a common paper path with each other. The first controller in the first printer may enable the first printer to operate if the common paper path is not in use by the second printer. In this case, the first controller may inform the second printer that the common paper path is in use by the first printer. On the other hand, the second controller in the second printer may enable the second printer to operate if the common paper path is not in use by the first printer. In this case, the second controller may inform the first printer that the common paper path is in use by the second printer.

15 Claims, 4 Drawing Sheets

PRINTING DEVICE AND METHOD

CROSS-REFERENCE TO RELATED APPLICATIONS

This application is based upon and claims the benefit of priority from Japanese Patent Application No. 2009-207329 filed on Sep. 8, 2009, the entire contents of which are incorporated herein by reference.

FIELD

Embodiments described herein relate generally to a printing device capable of performing printing on a thermal paper and a passbook.

BACKGROUND

A printing device capable of double printing on a thermal paper and a passbook has been developed and commercialized.

Such printing device may include a plurality of printing units each operating in response to commands provided from a host computer.

A system including two printing units may operate such that the two printing units are controlled by commands from a higher-level host computer.

However, a printing device having a plurality of printing units as mentioned above has some drawbacks. Due to the use of a single controller in controlling all the printing units, the printing performance degrades with an increase in printing data, such as graphic data. To alleviate this drawback, a controller having improved control performance needs to be used. However, such controller is costly, and accordingly the manufacturing costs of the printing device increase.

DETAILED DESCRIPTION

According to one embodiment, a printing device may include first and second printers respectively having first and second controllers. The first and second printers may be configured to share a common paper path with each other. In one embodiment, the first and second controllers cooperate to allocate a right of use of the common paper path to one of the first and second printers while the other is in a stand-by status. In one embodiment, the first and second controllers may be in communication with a host computer to arbitrate an exclusive right to use the common paper path between the first and second printers.

According to one embodiment, the first controller in the first printer may enable the first printer to operate if the common paper path is not in use by the second printer. In this case, the first controller may inform the second printer that the common paper path is in use by the first printer. On the other hand, the second controller in the second printer may enable the second printer to operate if the common paper path is not in use by the first printer. In this case, the second controller may inform the first printer that the common paper path is in use by the second printer.

Embodiments disclosed herein will be further described with the accompanying drawings.

Figure 1:
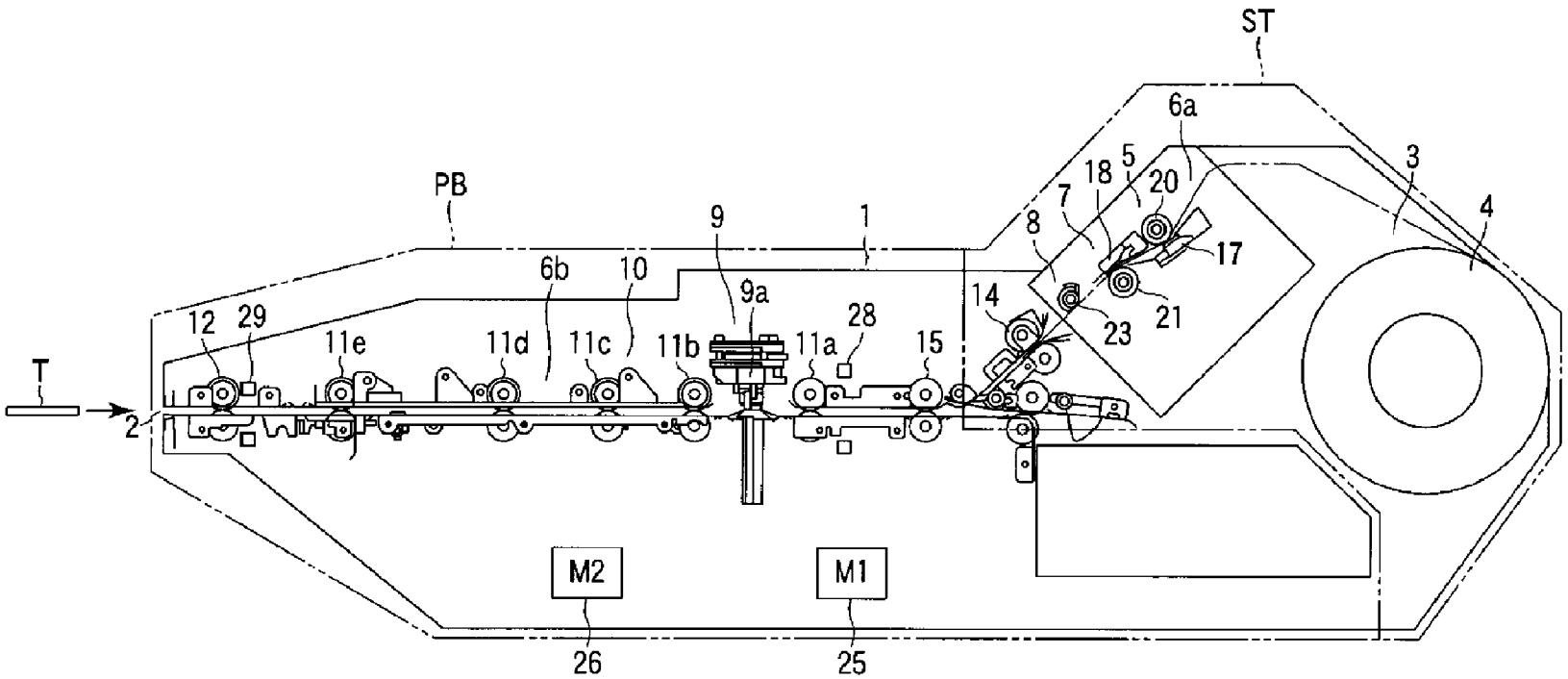
FIG. 1 is an illustrative embodiment of a diagrammatic side-elevational view showing an internal architecture of a printing device.

As shown in FIG. 1, a printing device 1 may include at a front portion a fascia part 2 that functions as an inlet/outlet of a passbook T and as an outlet of a statement paper. The printing device 1 may include a paper loading part 3 inside a rear portion in which a thermal paper roll 4 is loaded. The tip end of the thermal paper roll 4 may be pulled by a first conveying unit 5 and may be guided along a paper path 6*a*. A thermal printing part 7 and a cutting part 8 may be disposed along the paper path 6*a*.

The printing device 1 may further include a second conveying unit 10. The second conveying unit 10 may include pairs of conveying rollers 11*a* to 11*e*, a pair of feed in/out rollers 12, and a pair of feed rollers 15, all of which may be disposed along a paper path 6*b*. The second conveying unit 10 may convey the passbook T to be inserted to the fascia part 2 along the paper path 6*b* and may also convey the thermal paper 4 incoming through the paper path 6*a* toward the fascia part 2. A dot printing part 9 with a 24-pin dot-matrix head 9*a* may be disposed between the conveying rollers 11*a* and 11*b* on the paper path 6*b*. The pair of feed in/out rollers 12 may pick up the passbook T inserted into the fascia part 2, and send the passbook T printed by the dot printing part 9 or a printed statement paper to the exterior.

A paper sensor 28 may be disposed at the rear portion of the second conveying unit 10 to detect the tip end of the thermal paper roll 4. A passbook sensor 29 may be disposed in proximity to the feed in/out rollers 12 to detect insertion of the passbook T.

A thermal printing part 7 in the first conveying unit 5 may include first and second thermal heads 17 and 18 that are spaced apart from each other by a predetermined distance on the paper path 6*a*. First and second platen rollers 20 and 21 may be mounted to be in rotatable contact with the thermal heads 17 and 18, respectively.

The thermal paper 4 may be held and conveyed by the thermal heads 17 and 18 and the first and second platen rollers 20 and 21. The thermal heads 17 and 18 may enable information to be printed on the front and rear surfaces of the thermal paper 4 respectively.

The cutting part 8 may have a rotary cutter 23 that may rotate to have the thermal paper 4 cut when the tip end of the thermal paper 4 passes through the cutting part 8 over a predetermined distance. The piece thus cut is called a statement paper.

The first conveying unit 5 may include the first and second platen rollers 20 and 21 that are mounted to be in rotatable contact with the thermal heads 17 and 18, respectively, and a pair of feed rollers 14 that convey the statement paper cut by the rotary cutter 23 toward the second conveying unit 10. The platen rollers 20 and 21, the rotary cutter 23, and the pair of feed rollers 14 in the first conveying unit 5 may be rotary-driven by a motor 25. The pairs of conveying rollers 11*a* to 11*e*, the pair of feed in/out rollers 12, and the pair of feed rollers 15 in the second conveying unit 10 may be rotary-driven by a motor 26.

In the printing device 1, the combination of the paper loading part 3, the first conveying unit 5 and their peripheral parts constitutes a statement printer ST or a first printer, which conveys the thermal paper 4 along the paper path 6*a* and prints information thereon.

In the printing device 1, the combination of the pair of feed rollers 15, the second conveying unit 10 and their peripheral parts constitutes a passbook printer PB or a second printer, which conveys the passbook T for insertion thereto and prints information thereon. The passbook printer PB also conveys the thermal paper 4 produced by the operation of the statement printer ST.

Thus, the paper path 6*b* of the second conveying unit 10 may be shared by both the passbook printer PB and the statement printer ST.

Figure 2:
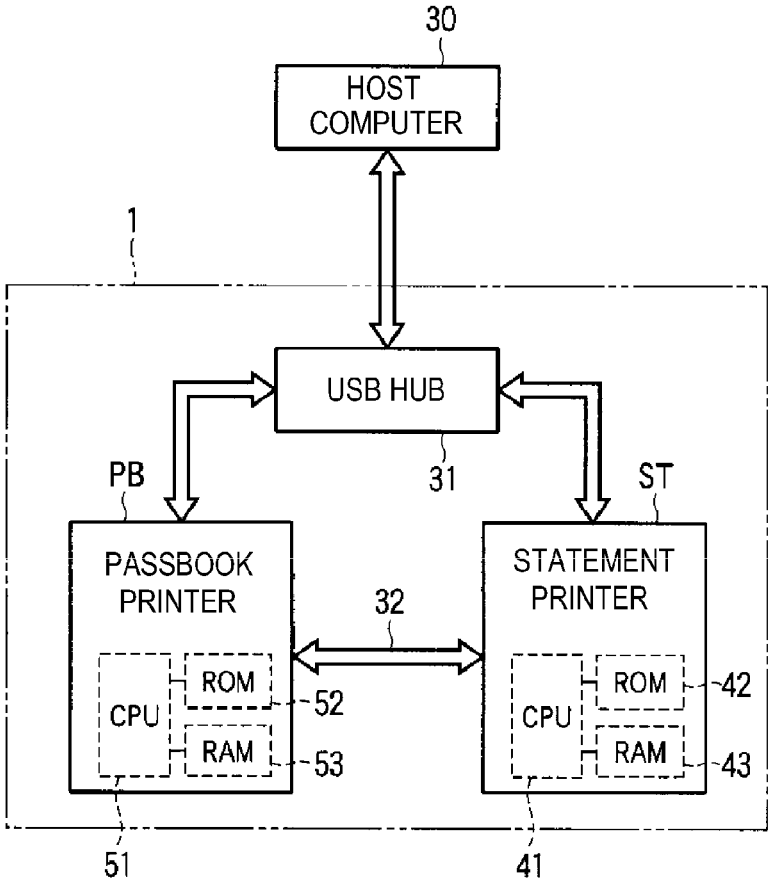
FIG. 2 is an illustrative embodiment of a block diagram showing a control circuit.

FIG. 2 shows an illustrative embodiment of a block diagram showing a control circuit. In FIG. 2, the statement printer ST and the passbook printer PB may be connected to a higher-level device, such as a host computer 30, via a USB hub 31. The statement printer ST and the passbook printer PB may be connected to each other via a communication interface 32.

The statement printer ST may include a CPU 41 as a first controller, a ROM 42 for storage of control programs, and a ROM 43 for storage of data. Both the ROM 42 and the RAM 43 may be connected to the CPU 41. The passbook printer PB may include a CPU 51 as a second controller, a ROM 52 for storage of control programs, and a RAM 53 for storage of data. Both the ROM 52 and the RAM 53 may be connected to the CPU 51.

For the execution of the required functions, the CPU 41 of the statement printer ST may include functional units, such as a check unit and first to sixth control units whose respective functions will be explained below.

(1) The check unit may check whether the paper path 6*b* is in use or occupied by the passbook printer PB based on a notification provided from the CPU 51 via the interface 32.

(2) The first control unit may inform the host computer 30 that the paper path 6*b* is in use by the passbook printer PB, i.e., is in a busy status, if the result of the check at the check unit is positive.

(3) The second control unit may enable the statement printer ST to operate based on a command provided from the host computer 30, if the result of the check is negative.

(4) With the enablement of the statement printer ST, the third control unit may inform the CPU 51 of the passbook printer PB that the paper path 6*b* is in use by the statement printer ST, which is currently in operation, via the interface 32.

(5) The fourth control unit may control the operation of the statement printer ST to be terminated in response to a command provided from the host computer 30.

(6) The fifth control unit may inform the host computer 30 that the statement printer ST is in a ready status, i.e., is in a stand-by status, as a result of the termination of its operation.

(7) Via the interface 32, the sixth control unit may notify the CPU 51 of the passbook printer PB that the right of use of the paper path 6*b* has been released by the statement printer ST, which terminated its operation.

Further, for the execution of its functions, the CPU 51 of the passbook printer PB may also include functional units, such as a check unit and first to sixth control units as explained below.

(11) The check unit may check whether the paper path 6*b* is in use or occupied by the statement printer ST based on a notification provided from the CPU 41 via the interface 32.

(12) The first control unit may inform the host computer 30 that the paper path 6*b* is in use by the statement printer ST, i.e., is in a busy status, if the result of the check at the check unit is positive.

(13) The second control unit may enable the passbook printer PB to operate based on a command provided from the host computer 30, if the result of the check is negative.

(14) With the enablement of the passbook printer PB, the third control unit may inform the CPU 41 of the statement printer ST that the paper path 6*b* is in use by the passbook printer PB, which is currently in operation, via the interface 32.

(15) The fourth control unit may control the operation of the passbook printer PB to be terminated in response to a command provided from the host computer 30.

(16) The fifth control unit may inform the host computer 30 that the passbook printer PB is in a ready status, i.e., is in a stand-by status, as a result of the termination of its operation.

(17) Via the interface 32, the sixth control unit may notify the CPU 41 of the statement printer ST that the right of use of the paper path 6*b* has been released by the passbook printer PB, which terminated its operation.

Figure 3:
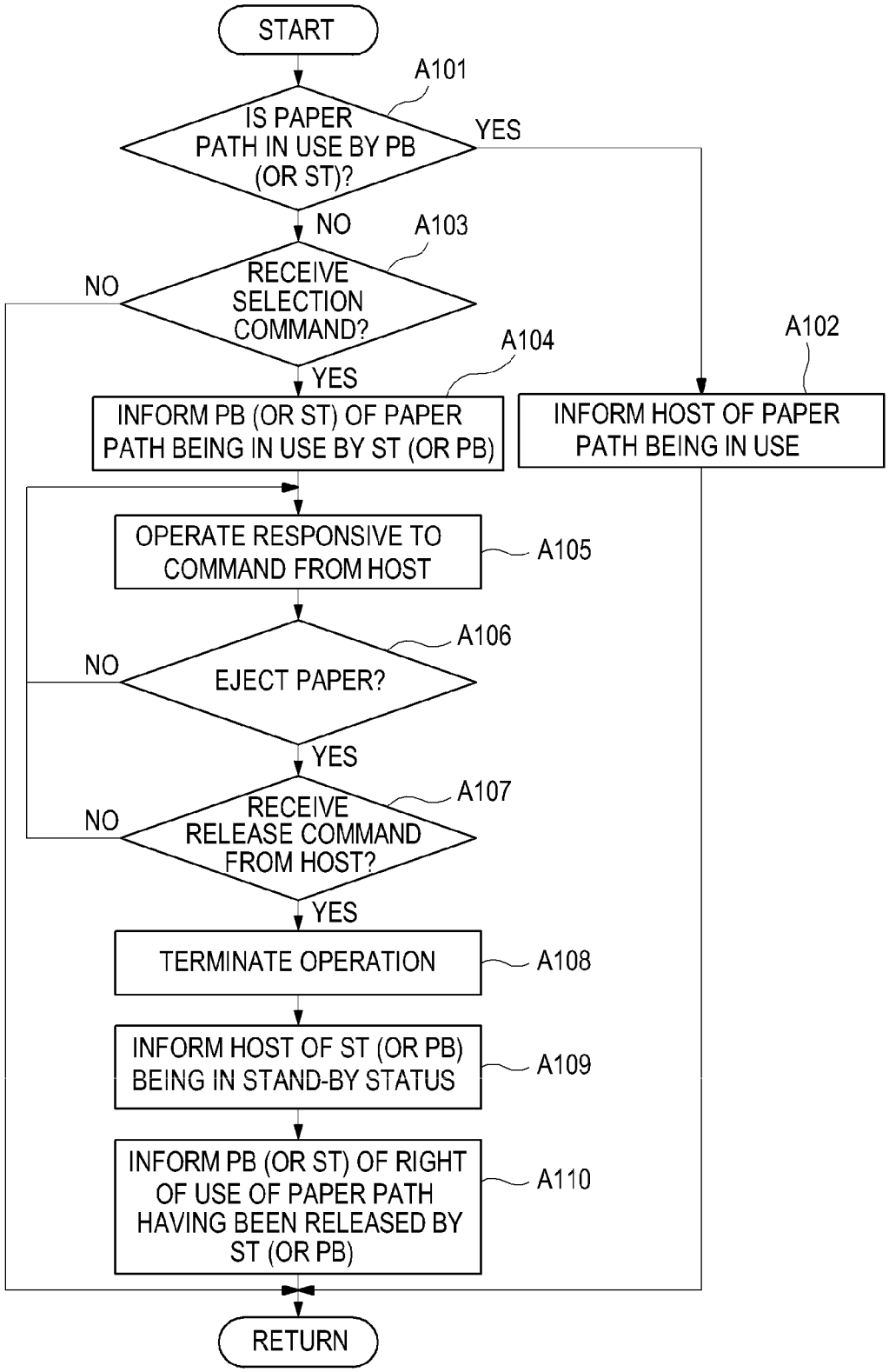
FIG. 3 is an illustrative embodiment of a flow chart explaining the operations of the printing device.
Figure 4:
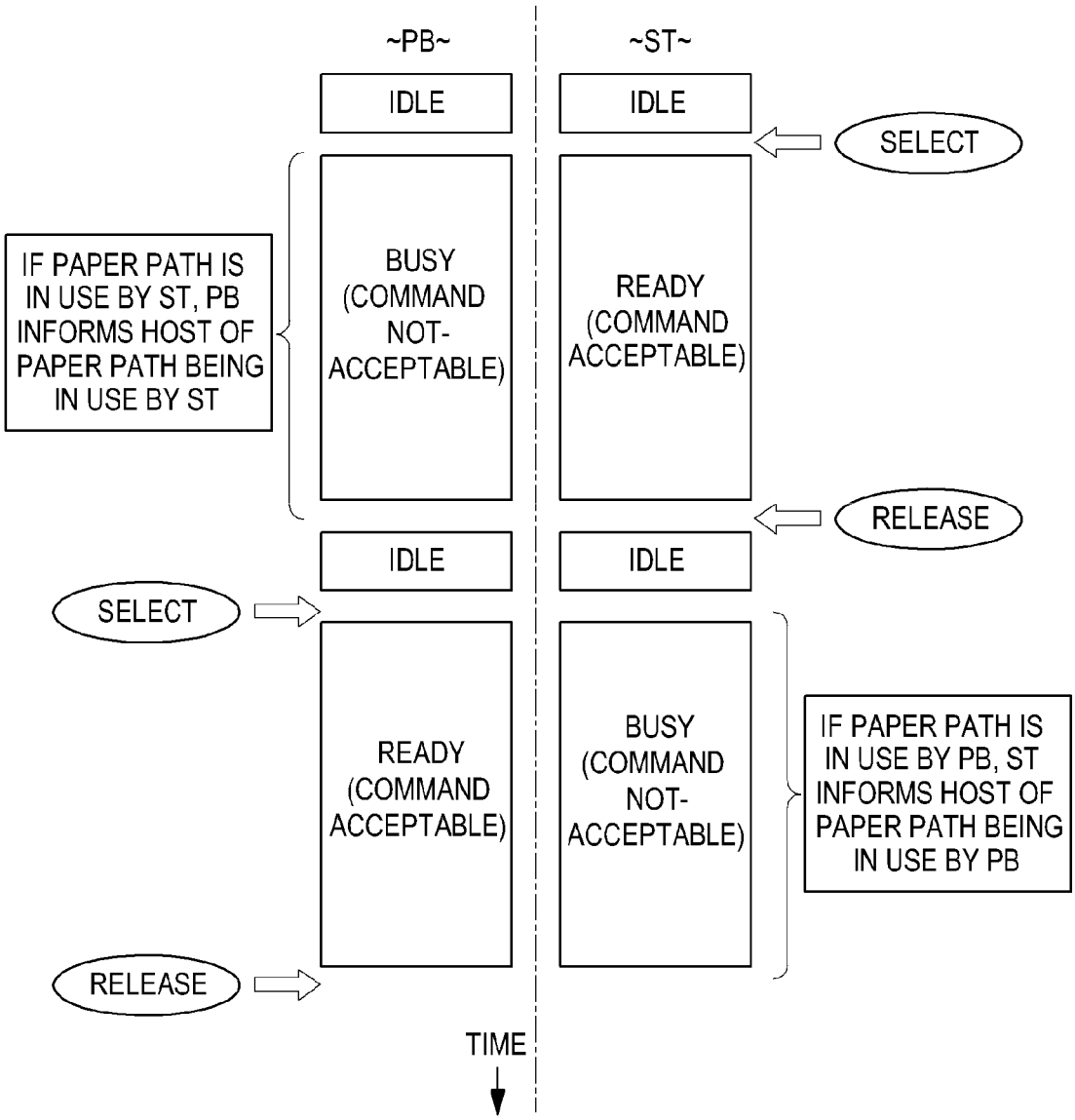
FIG. 4 is an illustrative embodiment of a status diagram for the operations of printers PB and ST.

Descriptions will now be made as to the operations of each of the printers ST and PB with reference to FIGS. 3 and 4, which respectively show an illustrative embodiment of a flow chart explaining the operations of the printing device, and an illustrative embodiment of a status diagram for the operations of the printers PB and ST.

Initially, the operation of the statement printer ST will be described. The CPU 41 of the statement printer ST checks whether the paper path 6*b* is in use or occupied by the passbook printer PB based on a notification provided from the CPU 51 via the interface 32 (act A101). If the result of the check is positive (YES of act A101), the CPU 41 informs the host computer 30 that the paper path 6*b* is in use by the passbook printer PB, i.e., is in a busy status (act A102).

If the result of the check is negative (NO of act A101), that is, if the paper path 6*b* is not in use by the passbook printer PB; and if the statement printer ST receives a selection command from the host computer 30 (YES of act A103), then via the interface 32, the CPU 41 of the statement printer ST informs the CPU 51 of the passbook printer PB that the paper path 6*b* is currently used or occupied by the statement printer ST (act A104). Then, the statement printer ST operates in response to a command provided from the host computer 30 (act A105). In this way, the statement printer ST may perform the tasks of conveying, thermal-printing and cutting operations on the thermal paper 4.

Thereafter, the statement printer ST ejects the thermal paper 4 which has been printed and cut (YES of act A106). Subsequently, if the statement printer ST receives a release command provided from the host computer 30 (YES of act A107), control proceeds to act A108 where the operation of the statement printer ST is terminated.

Upon termination of its operation, the CPU 41 of the statement printer ST informs the host computer 30 that the statement printer ST is in a stand-by status, i.e., is in an idle status (act A109). At the same time, via the interface 32, the CPU 41 informs the CPU 51 of the passbook printer PB that the right of use of the paper path 6*b* has been released by the statement printer ST (act A110).

The operations of the passbook printer PB will now be described. The CPU 51 of the passbook printer PB checks whether the paper path 6*b* is in use or occupied by the statement printer ST based on a notification provided from the CPU 41 via the interface 32 (act A101). If the result of the check is positive (YES of act A101), the CPU 51 informs the host computer 30 that the paper path 6*b* is in use by the statement printer ST, i.e., is in a busy status (act A 102).

If the result of the check is negative (NO of act A101), that is, if the paper path 6*b* is not in use by the statement printer ST;

and if the passbook printer PB receives a selection command from the host computer 30 (YES of act A103), then via the interface 32, the CPU 51 of the passbook printer PB informs the CPU 41 of the statement printer ST that the paper path 6*b* is in use or occupied by the passbook printer PB (act A104). Then, the passbook printer PB operates in response to a command provided from the host computer 30 (act A105). In this way, the passbook printer PB may perform conveying and dot-matrix printing operations on the passbook T.

Thereafter, the passbook printer PB ejects the passbook T, which has been dot-printed (YES of act A106). Subsequently, if the passbook printer PB receives a release command provided from the host computer 30 (YES of act A107), control proceeds to act A108 where the operation of the passbook printer PB is terminated.

Upon termination of its operation, the CPU 51 of the passbook printer PB informs the host computer 30 that the passbook printer PB is in a stand-by status, i.e., is in an idle status (act A109). At the same time, via the interface 32, the CPU 51 informs the CPU 41 of the statement printer ST that the right of use of the paper path 6*b* has been released by the passbook printer PB (act A110).

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus and can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS(Operating System) or the like in the apparatus.

As mentioned above, the CPUs 41 and 52 may be installed in the respective printers ST and PB, with the interface 32 being installed between the printers ST and PB, to monitor the occupation status of the paper path 6*b*. With such installation, it is made possible for the printers ST and PB to share the paper path 6*b*. Further, it is made possible to control each of the printers ST and PB independently or in consideration of the operation status of its counterpart.

As stated above, with the use of one controller in controlling a plurality of printing units, the printing performance may degrade as print data, such as graphic data, increases. In the embodiment illustrated above, the printers ST and PB may implement independent control functions, thereby allowing proper printing operations to be made without performance degradation even with an increased amount of print data. Furthermore, each of the CPUs 41 and 51 may perform independent control over the respective printer ST or PB, so that it is possible to reduce control load upon each of the CPUs 41 and 51 and to reduce the manufacturing costs of the printing device, which otherwise would be increased due to the required level of performance.

Furthermore, such independent control may allow detaching either the printer ST or the printer PB from the printing device 1 for replacement. That is, if one printer is normal and the other is abnormal, it is possible to minimize reconfiguration costs from being incurred for maintenance and repair.

The CPUs 41 or 51 may inform the host computer 30 that the paper path 6*b* is in use by any of the printers ST and PB, i.e., is in a busy status, and may also inform that any of the printers ST and PB is in a ready status, i.e., is in a stand-by status. This allows the host computer 30 to recognize the status of printers ST and PB properly and easily, thereby achieving a reduction in control load to be imposed upon the host computer 30.

While certain embodiments have been described, these embodiments have been presented by way of example only, and are not intended to limit the scope of the disclosures. Indeed, the novel printing device described herein may be embodied in a variety of other forms; furthermore, various omissions, substitutions and changes in the form of the printing device described herein may be made without departing from the spirit of the disclosures. The accompanying claims and their equivalents are intended to cover such forms or modifications as would fall within the scope and spirit of the disclosures.

What is claimed is:

1. A printing device comprising:

a first and a second printer configured to share a common paper path, the first printer printing on a first paper and the second printer printing on a second paper;

a fascia part serving as an outlet of the first paper and as an inlet and outlet of the second paper;

a first controller placed in the first printer and configured to enable the first printer to operate if the common paper path is not in use by the second printer, the first controller being further configured to inform the second printer of the common paper path being in use by the first printer; and a second controller placed in the second printer and configured to enable the second printer to operate if the common paper path is not in use by the first printer, the second controller being further configured to inform the first printer of the common paper path being in use by the second printer.

2. The device of claim 1, wherein the first controller includes:

means responsive to a first command provided from a higher-level device for enabling the first printer to operate if the common paper path is not in use by the second printer;

means responsive to the enablement of the first printer for informing the second controller that the common paper path is in use by the first printer;

means for terminating operations of the first printer responsive to a second command provided from the higher-level device;

means responsive to the termination of the operations of the first printer for informing the higher-level device that the first printer is in a stand-by status; and means responsive to the termination of the operations of the first printer for informing the second controller that a right of use of the common paper path has been released by the first printer, wherein the second controller includes:

means responsive to a third command provided from the higher-level device for enabling the second printer to operate if the common paper path is not in use by the first printer;

means responsive to the enablement of the second printer for informing the first controller that the common paper path is in use by the second printer;

means for terminating operations of the second printer responsive to a fourth command provided from the higher-level device;

means responsive to the termination of the operations of the second printer for informing the higher-level device that the second printer is in a stand-by status; and means responsive to the termination of the operations of the second printer for informing the first controller that a right of use of the common paper path has been released by the second printer.

3. The device of claim 1, further comprising a communication interface connected between the first and second controllers.

4. The device of claim 3, wherein the first controller comprises:

means for checking whether the common paper path is not in use by the second printer based on a first notification provided from the second controller via the interface;

means for enabling the first printer to operate responsive to a first command provided from a higher-level device if it is determined that the common paper path is not in use by the second printer;

means responsive to the enablement of the first printer for informing the second controller of the common paper path being in use by the first printer via the interface;

means for terminating operations of the first printer responsive to a second command provided from the higher-level device;

means responsive to the termination of the operations of the first printer for informing the higher-level device that the first printer is in a stand-by status; and means responsive to the termination of the operations of the first printer for informing the second controller of a right of use of the common paper path having been released by the first printer via the interface, wherein the second controller includes:

means for checking whether the common paper path is not in use by the first printer based on a second notification provided from the first controller via the interface;

means for enabling the second printer to operate responsive to a third command provided from the higher-level device if it is determined that the common paper path is not in use by the first printer;

means responsive to the enablement of the second printer for informing the first controller of the common paper path being in use by the second printer via the interface;

means for terminating operations of the second printer responsive to a fourth command provided from the higher-level device;

means responsive to the termination of the operations of the second printer for informing the higher-level device of the second printer being in a stand-by status; and means responsive to the termination of the operations of the second printer for informing the first controller of a right of use of the common paper path having been released by the second printer via the interface.

5. The device of claim 3, wherein the first controller comprises:

means for checking whether the common paper path is in use by the second printer based on a first notification provided from the second controller via the interface;

means for informing the higher-level device that the common paper path is in use by the second printer if it is determined that the common paper path is in use by the second printer;

means for enabling the first printer to operate responsive to a first command provided from the higher-level device if it is determined that the common paper path is not in use by the second printer means responsive to the enablement of the first printer for informing the second controller of the common paper path being in use by the first printer via the interface;

means for terminating operations of the first printer responsive to a second command provided from the higher-level device;

means responsive to the termination of the operations of the first printer for informing the higher-level device that the first printer is in stand-by status; and means responsive to the termination of the operations of the first printer for informing the second controller of a right of use of the common paper path having been released by the first printer via the interface, wherein the second controller includes:

means for checking whether the common paper path is in use by the first printer based on a second notification provided from the first controller via the interface;

means for informing the higher-level device that the common paper path is in use by the first printer if it is determined that the common paper path is in use by the first printer;

means for enabling the second printer to operate responsive to a third command provided from the higher-level device if it is determined that the common paper path is not in use by the first printer;

means responsive to the enablement of the second printer for informing the first controller of the common paper path being in use by the second printer via the interface;

means for terminating operations of the second printer responsive to a fourth command provided from the higher-level device;

means responsive to the termination of the operations of the second printer for informing the higher-level device of the second printer being in a stand-by status; and means responsive to the termination of the operations of the second printer for informing the first controller of a right of use of the common paper path having been released by the second printer via the interface.

6. A printing device comprising:

a statement printer operable to feed out a printed thermal paper through a paper path;

a passbook printer operable to feed in a passbook through the paper path; and a fascia part serving as an outlet of the printed thermal paper and as an inlet and outlet of the passbook, the statement printer and the passbook printer sharing the paper path in a manner that the statement printer feeds out the printed thermal paper through the paper path while the passbook printer is in a stand-by status and the passbook printer feeds in the passbook through the paper path while the statement printer is in a stand-by status.

7. The device of claim 6, wherein the statement printer comprises a first controller and the first controller comprises means for checking whether the paper path is in use by the passbook printer and means responsive to a command from a host computer for feeding out the printed thermal paper through the paper path based on a result of the check.

8. The device of claim 7, wherein the passbook printer comprises a second controller and the second controller comprises means for checking whether the paper path is in use by the statement printer and means responsive to the command from the host computer for feeding in the passbook through the paper path based on a result of the check.

9. The device of claim 8, wherein the first controller is operatively connected to the second controller and the means for checking in the first controller comprises means for checking whether the paper path is in use by the passbook printer based on a notification from the second controller.

10. The device of claim 8, wherein the first controller is operatively connected to the second controller and the means for checking in the second controller comprises means for checking whether the paper path is in use by the statement printer based on a notification from the first controller.

11. A printing device comprising:

a first printer having a first controller and printing on a first paper;

a second printer having a second controller and printing on a second paper; and a fascia part serving as an outlet of the first paper and as an inlet and outlet of the second paper, the first and second printers sharing a paper path and the first and second controllers cooperate to allocate a right of use of the paper path to one of the first and second printers while the other is in a stand-by status.

12. The device of claim 11, wherein the first controller comprises means for communicating with the second controller and a host computer to allocate the right of use of the paper path to the first printer.

13. The device of claim 11, wherein the second controller comprises means for communicating with the first controller and a host computer to allocate the right of use of the paper path to the second printer.

14. The device of claim 11, further comprising a communication interface connected between the first and second controllers.

15. A printing device comprising:

a first printer having a first controller and printing on a first paper;

a second printer having a second controller and printing on a second paper;

a fascia part serving as an outlet of the first paper and as an inlet and outlet of the second paper; and a host computer operatively connected to the first and second printers, the first and second printers sharing a paper path and the host computer is in communication with the first and second controllers to arbitrate an exclusive right to use the paper path between the first and second printers.

* * * * *